US012031288B1

(12) United States Patent
Scott et al.

(10) Patent No.: US 12,031,288 B1
(45) Date of Patent: Jul. 9, 2024

(54) SYSTEMS AND METHODS FOR MITIGATION OF BEACH EROSION AND ESCARPMENTS

(71) Applicant: ShoreLock, LLC, Miami, FL (US)

(72) Inventors: Troy M. Scott, Stuart, FL (US); Blayne Ross, Miami, FL (US)

(73) Assignee: ShoreLock, LLC, Miami, FL (US)

( * ) Notice: Subject to any disclaimer, the term of this patent is extended or adjusted under 35 U.S.C. 154(b) by 0 days.

(21) Appl. No.: 18/457,561

(22) Filed: Aug. 29, 2023

(51) Int. Cl.
*E02D 3/12* (2006.01)
*E02B 3/12* (2006.01)

(52) U.S. Cl.
CPC . *E02D 3/12* (2013.01); *E02B 3/12* (2013.01)

(58) Field of Classification Search
CPC ..... E02D 3/12; E02B 3/12
See application file for complete search history.

(56) References Cited

U.S. PATENT DOCUMENTS 240,051 A * 4/1881 Stevens ..... B65G 53/30 406/40
2,329,148 A * 9/1943 Leeuwen ..... C09K 17/40 405/263
5,556,703 A * 9/1996 Gross ..... A61L 15/40 536/3

FOREIGN PATENT DOCUMENTS

KR 100940802 B1 * 4/2009

OTHER PUBLICATIONS

Screen captures from YouTube video entitled "Shorelock Animated Explainer Video", 6 pages, published on Jan. 27, 2021 by user "ShoreLock". Retrieved from Internet: <https://www.youtube.com/watch?v=HrNr92ziNHU>.

* cited by examiner

*Primary Examiner* — Tara Mayo
*Assistant Examiner* — Tara Mayo-Pinnock
(74) *Attorney, Agent, or Firm* — Scale LLP

(57) ABSTRACT

Embodiments for mitigating beach erosion and escarpments include a system comprising an offshore hydraulic dredging vessel; a conduit connected to the offshore hydraulic dredging vessel, wherein the conduit carries sand and seawater to the beach; a reservoir, wherein the reservoir is connected to the conduit; and a sand stabilization compound, wherein the sand stabilization compound is mixed with seawater in the reservoir to form a slurry; wherein the offshore hydraulic dredging vessel pumps the slurry, sand, and seawater to the beach.

18 Claims, 6 Drawing Sheets

SYSTEMS AND METHODS FOR MITIGATION OF BEACH EROSION AND ESCARPMENTS

FIELD OF THE DISCLOSURE

This disclosure relates to systems and methods for mitigation of beach erosion and escarpments.

BACKGROUND

Soil and coastal erosion affects diverse geographic regions used for farming, recreation, and real estate worldwide. Between 1984 and 2015, an estimated 28,000 km2 was lost to coastal erosion. In the United States, more than 80,000 acres of coastal wetlands are lost each year with a $500 million loss of coastal property alone. Current mitigation for coastal erosion includes beach nourishment techniques such as offshore dredging and sand mining from inland sources.

Offshore ocean dredging for the purpose of coastal nourishment is the process of removing sand from the seabed floor to create or maintain sandy beaches along the shoreline. It involves using specialized equipment such as hopper dredges, which can include suction pumps, excavators, or cutterheads, to loosen and extract the materials from the seabed. The dredged materials are transported and deposited to the shoreline via a pipeline Sand mining involves the extraction of sand from inland quarries that match a similar sediment type, color, and grain size. Extraction methods may involve bulldozers, excavators, drills, or scraping. Mined sand must be screened and processed, which may include washing, sorting, and removing debris in order to collect sand that is compatible with the existing beach. Mined sand can come from any distance location and requires transportation by dump truck, rail, or freight.

Both offshore dredging and sand mining from inland sources are extremely disruptive to the marine offshore and onshore environment. Additionally, both approaches result in a significant burning of fossil fuels to power the equipment utilized in sand procurement and placement. Renourished beaches erode at a rate of 3-4 times faster than natural beaches, and the deposited sand smothers nearshore marine resources such as seagrass beds and hardbottom habitats. Renourished beaches almost always exhibit significant erosion escarpments due to wave scouring of poorly mixed aggregates. Among other problems, these escarpments are safety hazards for beachgoers and completely destroy the habitat of nesting sea turtles by preventing females from reaching dry beach to lay their eggs.

An erosion escarpment refers to a steep, often vertical or near-vertical, geological feature that is created by the process of erosion. It is characterized by a sharp and pronounced change in elevation between two adjacent landforms. Erosion escarpments typically develop when the ocean wears away the less compact sand on a beach, leaving an elevation change at the mean high-water mark. Escarpments can be any height and can make it difficult or impossible to move from one elevation plain to another safely. Accordingly, there is a need for a solution that mitigates coastal erosion, both during and after a beach nourishment process, that reduces sediment loss in a manner that is safe for beachgoers and protects wildlife habitats.

SUMMARY

The following description presents a simplified summary in order to provide a basic understanding of some aspects described herein. This summary is not an extensive overview of the claimed subject matter. It is intended to neither identify key or critical elements of the claimed subject matter nor delineate the scope thereof.

In some embodiments, a method for escarpment mitigation comprises digging one or more rows of vertical holes landward of an escarpment. Embodiments optionally include digging a row of vertical holes at the base of the escarpment. A sand stabilization compound is mixed with water (e.g., seawater) to create a slurry, and the previously dug holes are filled with the slurry. In alternative embodiments, a trench can be used instead of or in combination with the one or more rows of holes.

In some embodiments, a method for escarpment mitigation comprises drilling one or more directional bores landward of an escarpment. Embodiments optionally include drilling a directional bore below the base of the escarpment. A sand stabilization compound is mixed with water (e.g., seawater) to create a slurry, and the previously drilled bores are filled with the slurry.

In some embodiments, a system for escarpment mitigation comprises a directional boring machine and a sand stabilization compound, wherein the directional boring machine is configured to drill one or more directional bores landward and/or at the base of an escarpment and to backfill the bore(s) with a slurry of sand stabilization compound and seawater.

In some embodiments, a method for escarpment mitigation includes mixing a sand stabilization compound with water (e.g., seawater) to create a slurry. The slurry is then added to a pipe pumping dredged sand and seawater; and the slurry, sand, and seawater is pumped onto a beach (e.g., as part of a beach nourishment project).

In some embodiments, a system for escarpment mitigation comprises an offshore hydraulic dredging vessel; a conduit connected to the offshore hydraulic dredging vessel, wherein the conduit carries sand and seawater to the beach; a reservoir, wherein the reservoir is connected to the conduit; and a sand stabilization compound, wherein the sand stabilization compound is mixed with seawater in the reservoir to form a slurry; wherein the offshore hydraulic dredging vessel pumps the slurry, sand, and seawater to the beach.

Further variations encompassed within the systems and methods are described in the detailed description of the invention below.

BRIEF DESCRIPTION OF THE DRAWINGS

The accompanying drawings, which are incorporated herein and form part of the specification, illustrate various, non-limiting embodiments of the present invention. In the drawings, like reference numbers indicate identical or functionally similar elements.

DETAILED DESCRIPTION

While aspects of the subject matter of the present disclosure may be embodied in a variety of forms, the following description and accompanying drawings are merely intended to disclose some of these forms as specific examples of the subject matter. Accordingly, the subject matter of this disclosure is not intended to be limited to the forms or embodiments so described and illustrated.

Figure 1:
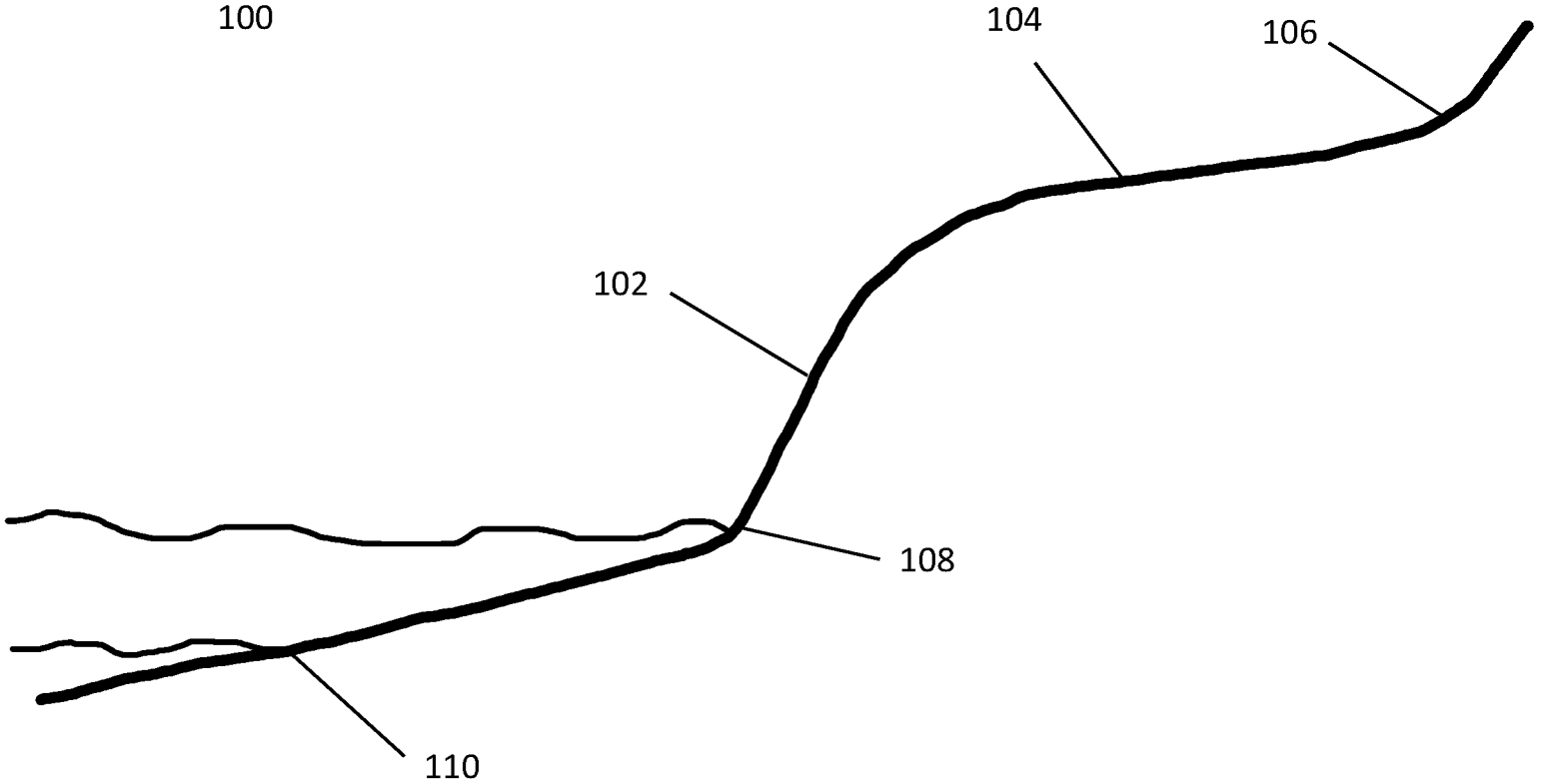
FIG. 1 depicts a coastal profile of an escarpment before an application of embodiments of the present invention.

FIG. 1 depicts a coastal profile 100 of an escarpment before an application of embodiments of the present invention. On an escarped beach, the high-tide water line or high-water mark 108 reaches to the base of the escarpment 102. Most escarpments 102 meet the high-water mark 108 at or close to a 90° angle and can be a few centimeters to several meters in height on a typical high (wave) energy beach. Coastal profile 100 also includes a low-tide water line or low-water mark 110. The top of the escarpment will meet the dry area of the beach 104 at another 90° angle and the dry beach 104 extends to the toe of a dune 106. In some cases, the escarpment 102 is formed at the base of the dune 106 and no dry, level beach area 104 exists. Sea turtle nests must remain dry during the incubation period and are typically built several meters landward of the high-water mark 108. Even a small erosion escarpment 102 can be a hindrance to a successful nesting event. Large escarpments are also attributable to an increase in rip currents in certain situations. Accordingly, in addition to creating an immediate physical risk to beachgoers (i.e., a sudden drop of several feet or more), escarpments can create safety hazards in the surf as well. Embodiments of the present invention smooth out or "sculpt" beach escarpments 102 using novel systems and methods for applying a sand stabilization compound directly to and/or around the escarpment. These embodiments are described in more detail below.

Various techniques, both chemical and mechanical, have historically been used to stabilize soil in areas that cannot establish vegetation with the goal of protecting the soil from wind and stormwater erosion. Chemical applications, often referred to as soil binders, are typically sprayed onto soil that could not be controlled by other mechanical or vegetative means. Many of these chemical applications, however, are toxic to plant and animal life, and soil runoff can contaminate nearby water sources. While certain soil binders can help stabilize sandy terrain as well, the prior art solutions are not suitable for coastal applications because of the adverse health and environmental consequences.

Embodiments of the present invention include the application of a sand stabilization compound that is safe to use in coastal applications. A beach escarpment is formed at the sand/water interface because the dry or partially-wetted sand that is landward of the high-water mark is easily scoured due to the lack of cohesion provided by the hydrogen bonding properties of water. In embodiments, a sand stabilization compound acts as a hydrophilic wetting agent and simultaneously as a hydrophobic dewatering agent, which results in an optimized amount of interstitial water between individual sand grains. When applied to a beach in accordance with one or more of the embodiments described below, the escarpment collapses. The resulting new beach profile includes more dry sand, a receding high-water mark, and a beach environment that is safer for beachgoers and more easily accessible to nesting sea turtles.

Figure 2:
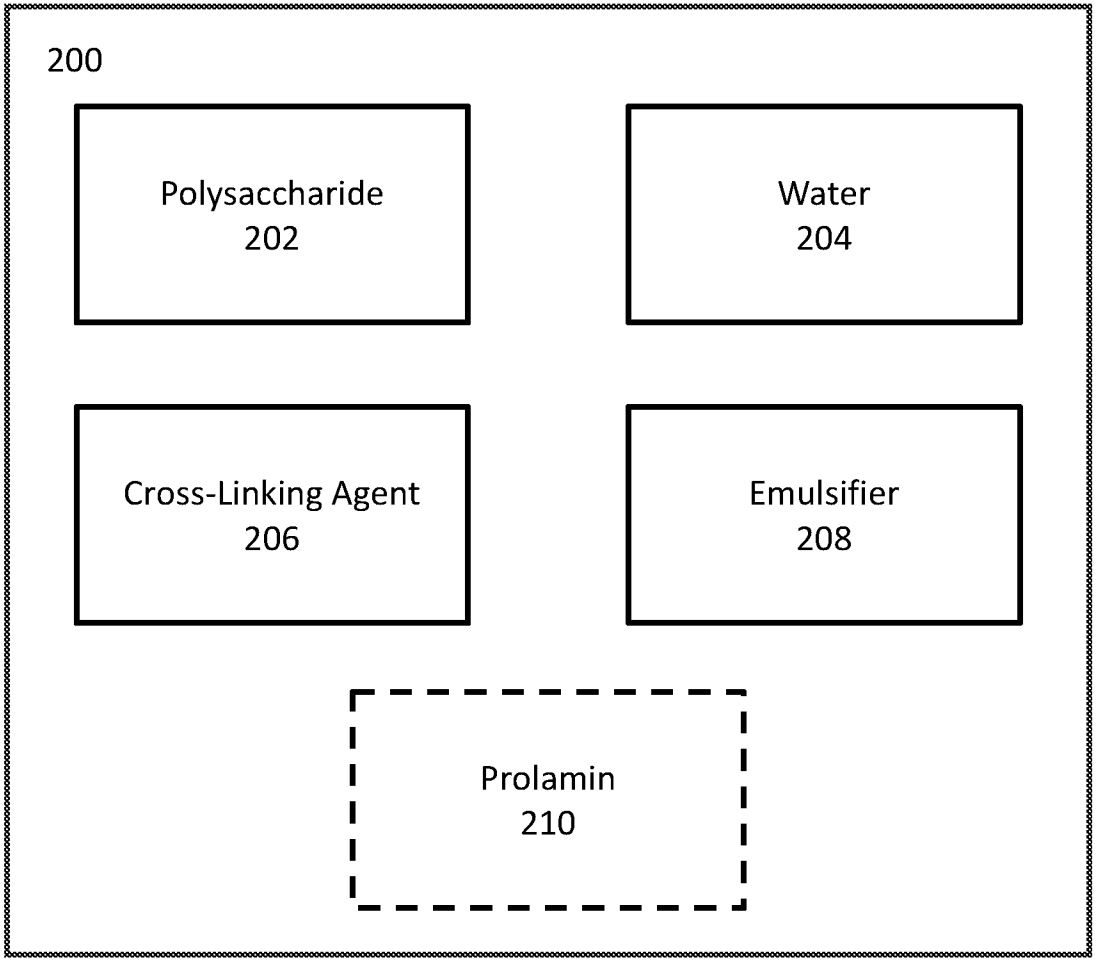
FIG. 2 depicts a diagram of an exemplary component composition of a sand stabilization compound.

FIG. 2 depicts a diagram of an exemplary component composition of a sand stabilization compound 200. In embodiments of the present invention, the sand stabilization compound 200 comprises one or more polysaccharides 202, water 204, one or more cross-linking agents 206, and an emulsifier 208. Some embodiments also include a prolamin 210.

Polysaccharides 202 are known for their hydrophilic properties and ability to form hydrogen bonds with water and aggregates. Accordingly, the addition of polysaccharides 202 to sand promotes water retention and sand cohesion, resulting in a more stabilized beach that resists erosion. In embodiments, the one or more polysaccharides 202 can be algae-derived phycocolloids and/or plant-derived gums mixed with one or more cross-linking agents 206. In some embodiments, the polysaccharide 202 is alginate, which can be crosslinked with one or more divalent cations (e.g., $Ca^{2+}$ or $Fe^{2+}$). In some embodiments, the polysaccharide 202 is carrageenan, which is crosslinked with one or more monovalent or divalent cations (e.g, $K^+$, $Na^+$, or $Ca^{2+}$). Some embodiments use a mixture of polysaccharides 202, such as alginate and carrageenan, which is crosslinked with one or more monovalent and/or divalent cations (e.g., $Ca^{2+}$).

Embodiments of the invention can utilize one or more plant-derived polysaccharides 202 (i.e., gums), including guar gum and locust bean gum, combined with or as an alternative to one or more phycocolloids. In some embodiments, the plant gum is guar gum, which can be complexed with sodium tetraborate decahydrate. In other embodiments, the plant gum is locust bean gum or a mixture of guar and locust bean gums complexed with sodium tetraborate decahydrate.

Embodiments of the sand stabilization compound 200 include an emulsifier 208. In embodiments, the emulsifier 208 is one or more of lecithin or a vegetable oil such as canola oil. Embodiments of the invention optionally include one or more plant proteins or prolamins 210, such as zein, to stabilize the sand stabilization compound 200.

In embodiments of the invention, the sand stabilization compound 200 is a hydrogel, which can be prepared by solubilizing the one or more polysaccharides 202 in water 204, followed by the addition of a cross-linking agent 206 (e.g., monovalent or divalent cations, borax, or a mixture thereof depending on the polysaccharides 202 being cross-linked). The hydrogel can then be stabilized by the addition of one or more emulsifiers 208. Optionally, prolamins 210 such as zein can be solubilized in 70% isopropanol and subsequently mixed with the cross-linked, emulsified, hydrogel. In embodiments, the resulting complex is then dried and milled into a fine powder.

In embodiments of the invention, a sand stabilization compound 200 is mixed with sand on a beach where there is a desire to limit erosion, whether it be for aesthetic, safety, or environmental reasons. In some embodiments, the sand stabilization compound is poured into holes above and or below an escarpment. In other embodiments, the sand stabilization compound is injected with, for example, a directional boring machine directly into or around an escarpment. In still other embodiments, the sand stabilization compound is added as a slurry to dredged sand that is being pumped onto a beach. These and other embodiments for applying the sand stabilization compound 200 are described in more detail below.

Figure 3:
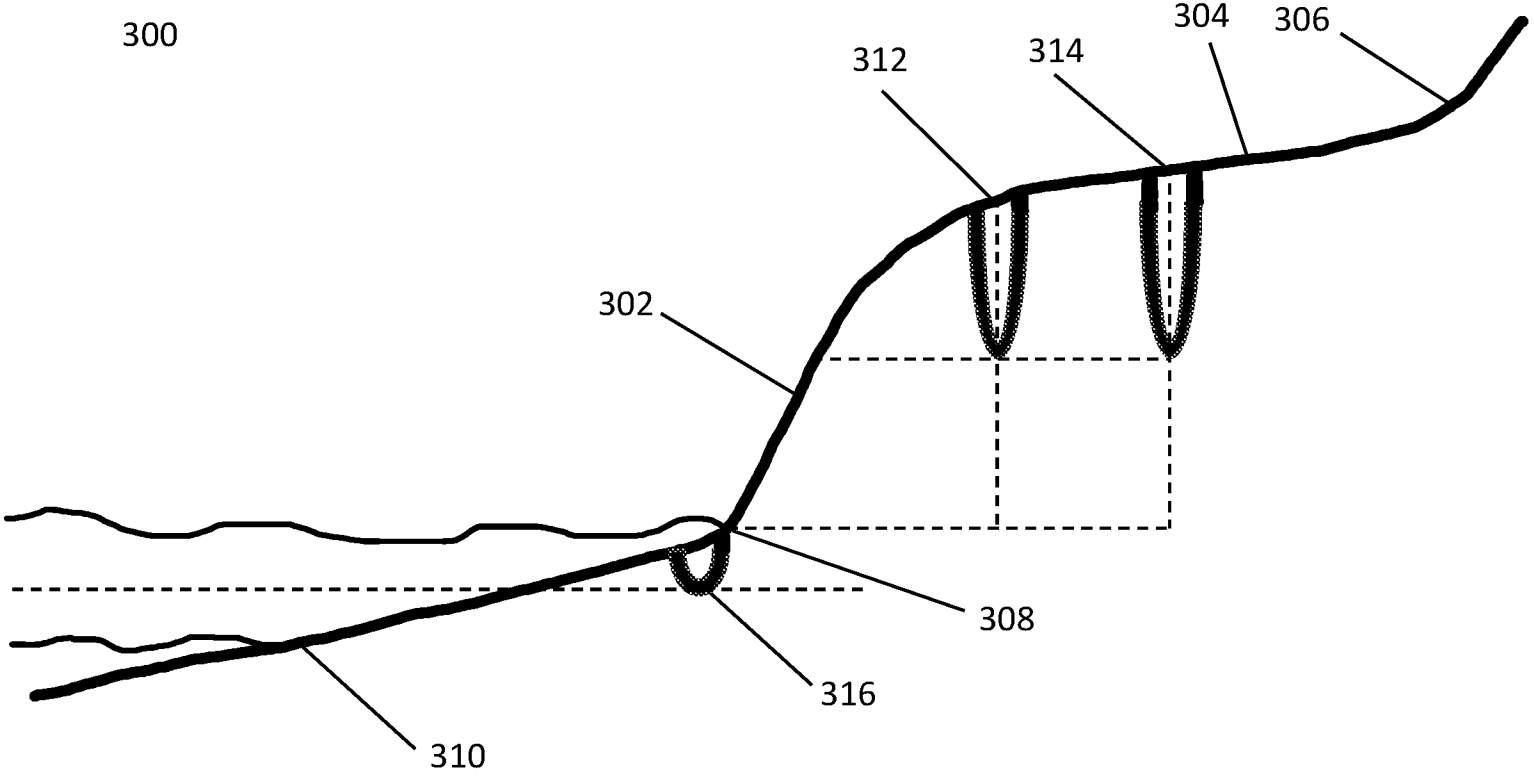
FIG. 3 depicts a diagram of aspects of systems and methods for escarpment mitigation.

FIG. 3 depicts a coastal profile 300 of embodiments of the present invention in which a sand stabilization compound 200 is deposited into vertical holes above and/or below an escarpment 302. Coastal profile 300 includes a dry area of beach 304 that extends to the toe of a dune 306. There is a high-water mark 308 and a low-water mark 310. In some embodiments, prior to the addition of the sand stabilization compound 200 to the beach, a plurality of vertical holes 312 are dug landward of the escarpment 302 in a row along the length of the escarpment 302. In some embodiments, the vertical holes 312 are dug at a distance from the face of the escarpment 302 of approximately one half of the escarpment height and to a depth of approximately one half of the escarpment height. In the same or alternative embodiments, a plurality of vertical holes 314 are dug even further landward of the escarpment 302 in a row along the length of the escarpment 302. In embodiments, the plurality of vertical holes 314 can be dug at a distance landward of the escarpment 302 approximately equal to the escarpment height and a depth of approximately one half of the escarpment height. In some embodiments, vertical holes 312 and 314 are placed approximately one meter apart along the top of the escarpment 302 in a staggered fashion (e.g., each row of vertical holes 312 and 314 can be offset by 0.5 meters). In the same or alternative embodiments, if the tidal phases and water levels permit, vertical holes 316 can be dug at the base of the escarpment 302 at similar intervals to vertical holes 312 and 314 and to a depth approximately equal to the water table (i.e., when the hole just begins to fill with water from below). It being understood that escarpments are often not fully vertical or of uniform shape or height, the depths, distances, and intervals described above can be modified to suit a particular escarpment without departing from the scope of the invention. Additionally, a "hole" does not need to be cylindrical in shape and can encompass other types of sand excavations. For example, in embodiments of the invention, one or more trenches or channels may be dug into the beach in accordance with the depths and distances described above.

Once a plurality of holes 312, 314, and/or 316 have been dug, the sand stabilization compound 200 can be added. In embodiments, the sand stabilization compound 200 is mixed with seawater (e.g., in a bucket, drum, or other container with or without its own mechanical mixer) to form a slurry. The slurry is then deposited into the holes 312, 314, and/or 316, and covered with sand.

Figure 4:
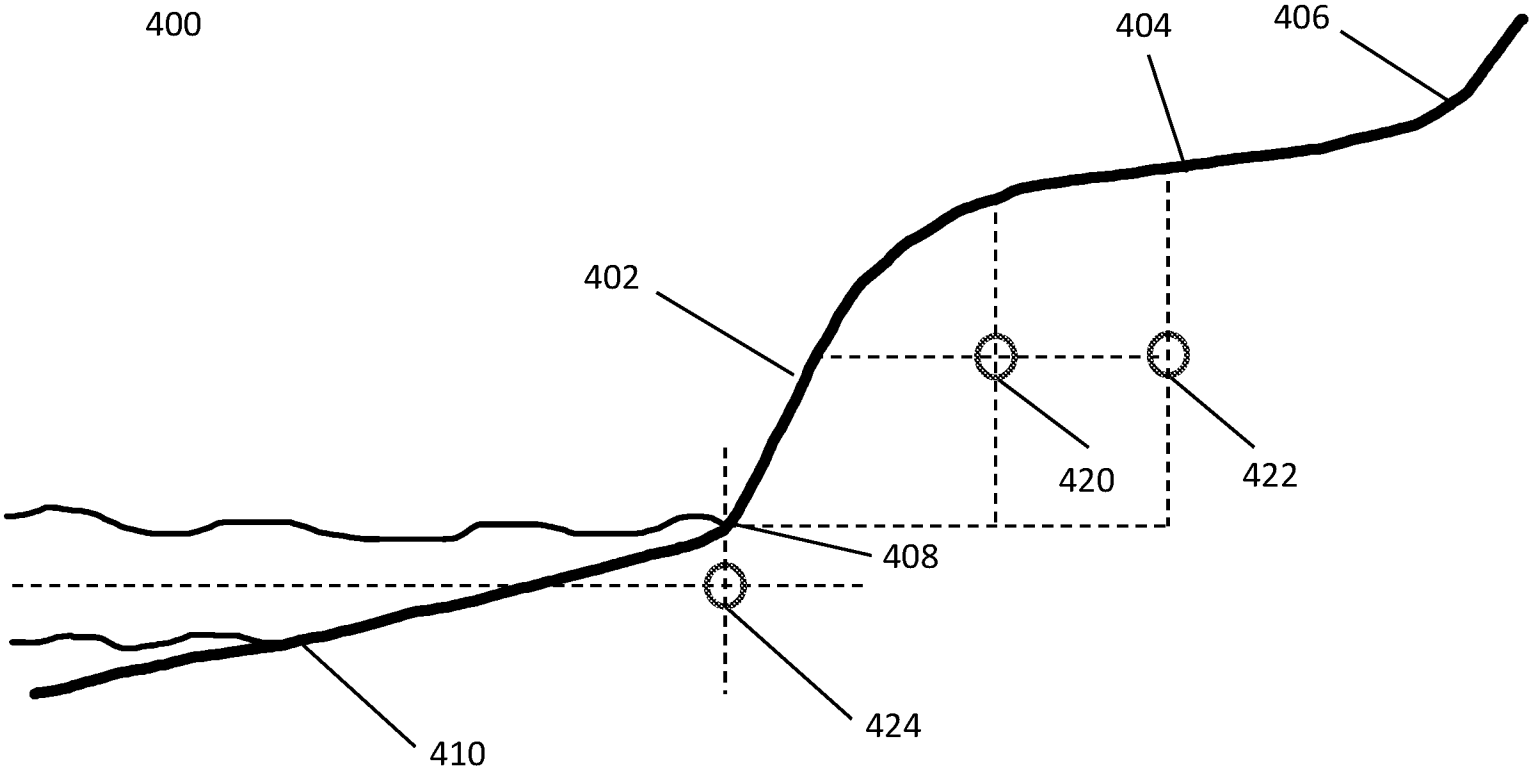
FIG. 4 depicts a diagram of aspects of systems and methods for escarpment mitigation.

FIG. 4 depicts a coastal profile 400 of embodiments of the present invention in which a sand stabilization compound 200 is injected horizontally into an escarpment 402. Coastal profile 400 includes a dry area of beach 404 that extends to the toe of a dune 406. There is a high-water mark 408 and a low-water mark 410. In embodiments, the sand stabilization compound 200 can be mixed in a mechanical mixer and injected using a directional boring process. In embodiments, the sand stabilization compound 200 is utilized as a drilling mud, mixed with seawater in a drilling mud mixer attached or connected to the directional boring machine, and injected into the sand around the escarpment 402 during the boring process. In other embodiments, the directional boring machine could drill a pilot hole and then pull a reamer through the pilot hole while injecting the sand stabilization compound 200 at various points along the escarpment 402 or continuously during the process.

In some embodiments, a directional bore 420 is dug landward of the escarpment 402 along the length of the escarpment 402. In some embodiments, the directional bore 420 is drilled at a distance from the face of the escarpment 402 of approximately one half of the escarpment height and at a depth of approximately one half the escarpment height. In the same or alternative embodiments, a directional bore 422 can be drilled even further landward of the escarpment 402 along the length of the escarpment 402. In embodiments, the directional bore 422 is drilled at a distance from the face of the escarpment 402 approximately equal to the escarpment height and at a depth of approximately one half of the escarpment height. In the same or alternative embodiments, if the tidal phases and water levels permit, a directional bore 424 is drilled below the foot of the escarpment 402 at a depth approximately equal to the water table (i.e., when the hole just begins to fill with water from below). It being understood that escarpments are often not fully vertical or of uniform shape or height, the depths and distances described above can be modified to suit a particular escarpment without departing from the scope of the invention.

In alternative embodiments, the sand stabilization compound is applied in and/or around an escarpment using a custom-built mobile injection machine. In embodiments, the mobile injection machine includes a reservoir, an injector, and transportation means. The reservoir can include a mixer for premixing the sand stabilization compound 200 with seawater, and optionally sand, to create a slurry. In some embodiments, the sand stabilization compound and seawater are stored in the same reservoir. In other embodiments, the sand stabilization compound 200 and seawater are stored in separate reservoirs and mixed at the time of injection. In some of these embodiments, the ratio of sand stabilization compound 200 to seawater is adjustable at the mobile injection machine. The injector, which can be embodied as a drill or needle-like apparatus, injects the slurry into and/or around the escarpment at the depths, distances, and intervals as described in one or more of the embodiments above. In embodiments, the injector is multi-directional and can inject horizontally to the side of the machine, vertically below the machine, and angles in between. In embodiments, the injector has an adjustable depth. In embodiments, the transportation means is a steerable motorized platform. In other embodiments, the transportation means is a trailer platform towed behind a vehicle.

In still other embodiments of escarpment mitigation, the sand stabilization compound 200 can be added as a slurry to dredged sand that is being pumped onto a beach as part of a beach renourishment process. In these embodiments, the sand stabilization compound 200 is premixed with seawater into a slurry using, for example, a mixer submerged in a large (e.g., 400L) reservoir. The premixed slurry is then injected in-line into a pipe carrying sand and seawater being pumped onto a beach by an off-shore hydraulic dredging apparatus or vessel. In some embodiments, the mixer and reservoir are located on the dredging vessel. In other embodiments, the mixer and reservoir are located on a mobile platform on the beach. In still other embodiments, the mixer and reservoir are located on a support vessel that is separate from the dredging vessel. In other embodiments, the sand stabilization compound is not premixed with seawater, but is added directly to the pipe at a steady rate where it mixes with the sand and seawater already in the pipe. These embodiments can work concurrently with all systems required for a traditional dredge and fill beach nourishment project. The mixture of slurry and sand is added to the beach to create a desired shoreline, the beach stabilizes as the amount of interstitial water between individual sand grains is optimized, and the benefits of the invention to humans and wildlife are achieved.

Figure 5A:
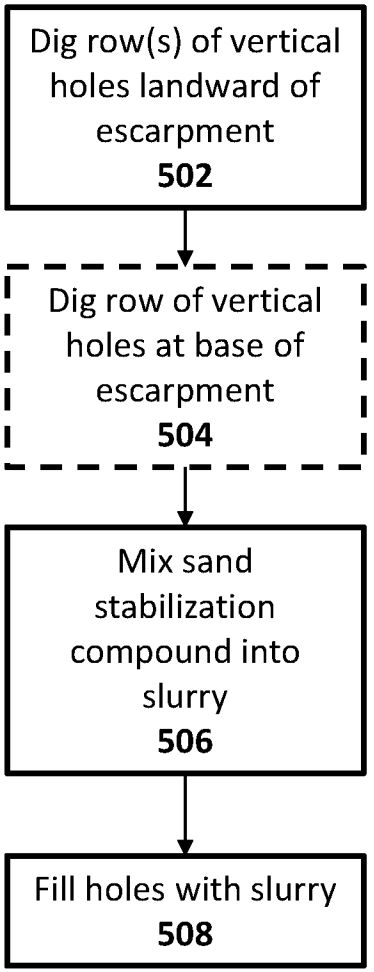
FIGS. 5A-5C depict flow charts of exemplary methods of escarpment mitigation.
Figure 5B:
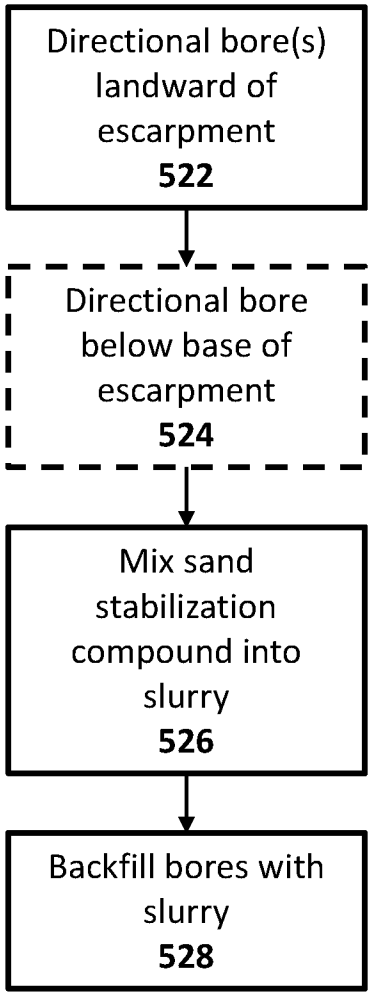
Figure 5C:
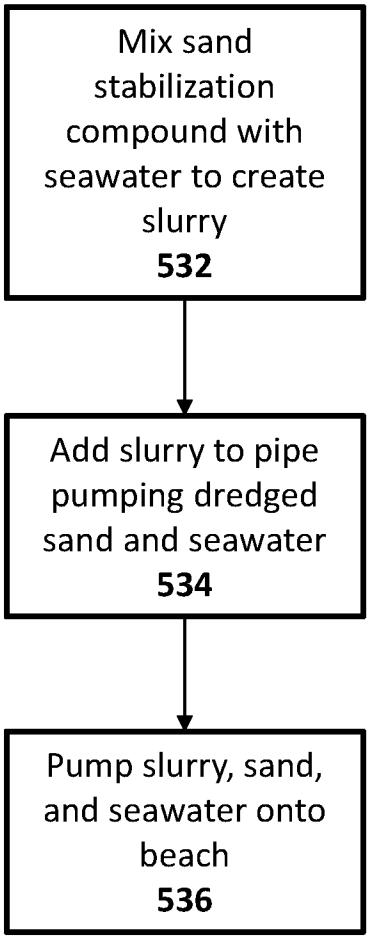

FIGS. 5A-5C depict flow charts of exemplary methods of escarpment mitigation. In FIG. 5A, an embodiment of escarpment mitigation includes step 502 of digging one or more rows of vertical holes landward of an escarpment. Embodiments optionally include step 504 of digging a row of vertical holes at the base of the escarpment. In step 506, a sand stabilization compound (e.g., sand stabilization compound 200) is mixed with water (e.g., seawater) to create a slurry. At step 508, the holes created in step 502 and optional step 504 are filled with the slurry.

In FIG. 5B, an embodiment of escarpment mitigation includes step 522 of drilling one or more directional bores landward of an escarpment. Embodiments optionally include step 524 of drilling a directional bore below the base of the escarpment. In step 526, a sand stabilization compound (e.g., sand stabilization compound 200) is mixed with water (e.g., seawater) to create a slurry. At step 528, the bores created in step 522 and optional step 524 are filled with the slurry.

In FIG. 5C, an embodiment of escarpment mitigation includes step 532, in which a sand stabilization compound (e.g., sand stabilization compound 200) is mixed with water (e.g., seawater) to create a slurry. At step 534, the slurry is added to a pipe pumping dredged sand and seawater. At step 536, the slurry, sand and seawater is pumped onto a beach (e.g., as part of a beach nourishment project).

Figure 6:
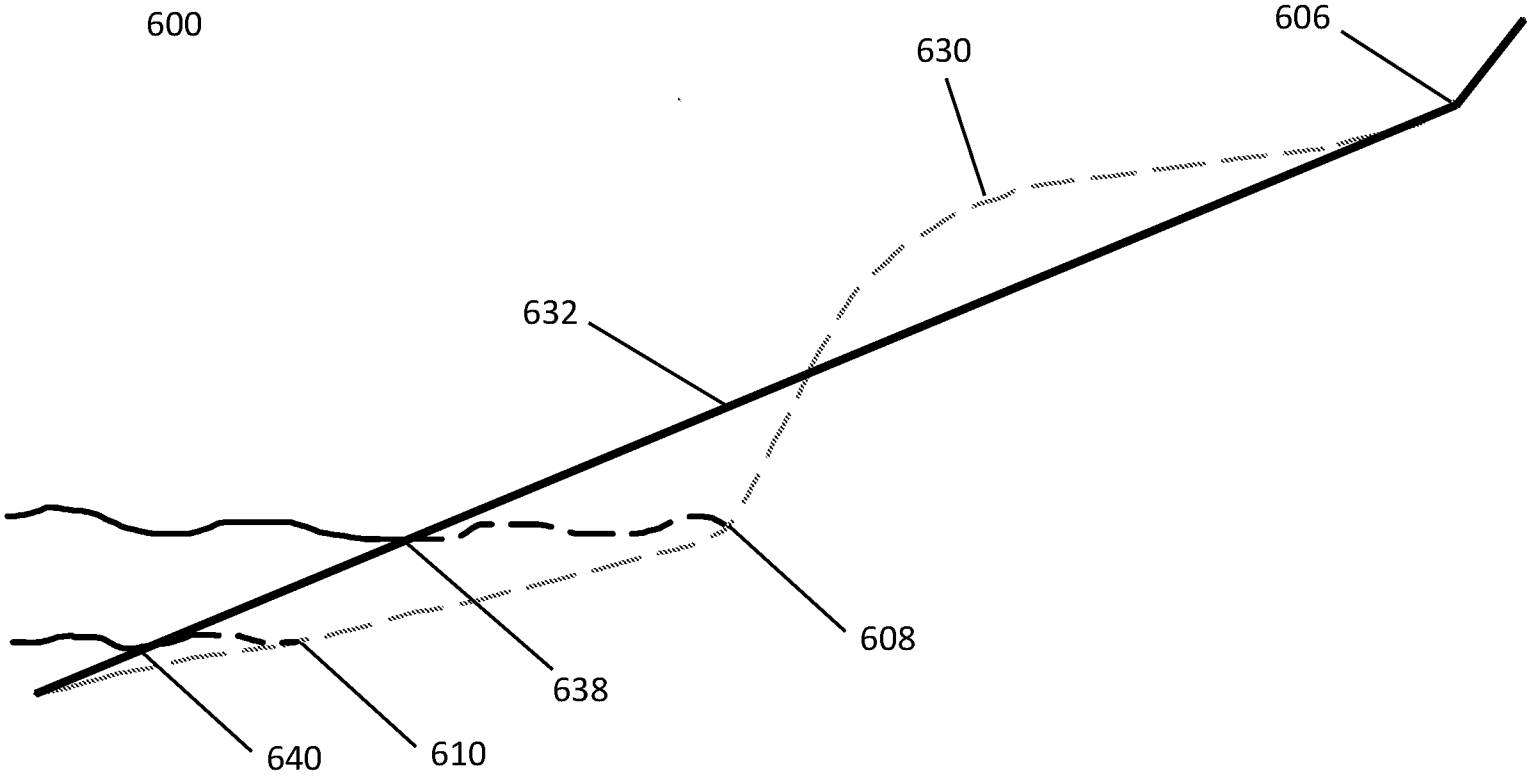
FIG. 6 depicts a coastal profile of an escarpment after an application of embodiments of the present invention.

FIG. 6 depicts a coastal profile 600 after an application of embodiments of the present invention. FIG. 6 illustrates an original beach profile 630 leading to the toe of a dune 606. The original beach profile 630 has a high-water mark 608 and a low-water mark 610. Following the addition of the sand stabilization compound 200 to the beach and subsequent tidal phases, the original beach profile 630 flattens and the erosion escarpment becomes significantly less pronounced or disappears entirely. A new beach profile 632 is formed with a new high-water mark 638 and a new low-water mark 640. The result is a collapse of the erosion escarpment, a sandy, dry beach that is pushed seaward, a receding high-water mark, and a beach environment that is safer for beachgoers traveling from the beach to the water and is easily accessible by nesting sea turtles traveling from the water to the beach.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure. Moreover, the descriptions of such embodiments, combinations, and sub-combinations are not intended to convey that the claimed subject matter requires features or combinations of features other than those expressly recited in the claims. Accordingly, the scope of this disclosure is intended to include all modifications and variations encompassed within the spirit and scope of the following appended claims.

The terminology used above may be interpreted in its broadest reasonable manner, even though it is being used in conjunction with a detailed description of certain specific examples of the present disclosure. Indeed, certain terms may even be emphasized above; however, any terminology intended to be interpreted in any restricted manner will be overtly and specifically defined as such in this Detailed Description section. Both the foregoing general description and the detailed description are exemplary and explanatory only and are not restrictive of the features, as claimed.

As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

In this disclosure, relative terms, such as, for example, "about," substantially," "generally," and "approximately" are used to indicate a possible variation of +10% in a stated value.

The term "exemplary" is used in the sense of "example" rather than "ideal." As used herein, the singular forms "a," "an," and "the" include plural reference unless the context dictates otherwise.

The invention claimed is:

1. A method for beach escarpment mitigation, the method comprising:

mixing a sand stabilization compound with seawater in a reservoir to form a slurry, wherein the sand stabilization compound is a hydrogel comprising one or more polysaccharides, one or more cross-linking agents, and one or more emulsifiers;

adding the slurry to a conduit carrying sand and seawater;

pumping the slurry, sand, and seawater to a beach; and creating a new shoreline with the pumped slurry, sand, and seawater.

2. The method of claim 1, wherein the one or more polysaccharides comprises one or more algae-derived phycocolloids.

3. The method of claim 1, wherein the one or more polysaccharides comprises one or more plant-derived gums.

4. The method of claim 1, wherein the pumping is performed by an offshore hydraulic dredging vessel, and wherein the sand is dredged from a seabed floor and pumped through the conduit by the offshore hydraulic dredging vessel.

5. The method of claim 4, wherein the reservoir is located on the offshore hydraulic dredging vessel.

6. The method of claim 4, wherein the reservoir is located on the beach.

7. The method of claim 4, wherein the reservoir is located on a support vessel.

8. The method of claim 1, wherein the beach comprises an escarpment, and wherein the pumped slurry, sand, and seawater collapses the escarpment.

9. The method of claim 8, wherein the beach includes one or more sea turtle nesting sites.

10. A system for beach escarpment mitigation, the system comprising:

an offshore hydraulic dredging vessel;

a conduit, wherein the conduit is connected to the offshore hydraulic dredging vessel, and wherein the conduit carries sand and seawater to a beach;

a reservoir, wherein the reservoir is connected to the conduit; and a sand stabilization compound, wherein the sand stabilization compound is mixed with seawater in the reservoir to form a slurry, and wherein the sand stabilization compound is a hydrogel comprising one or more polysaccharides, one or more cross-linking agents, and one or more emulsifiers;

wherein the offshore hydraulic dredging vessel pumps the slurry, sand, and seawater to the beach, wherein the pumped slurry, sand, and seawater creates a new shoreline.

11. The system of claim 10, wherein the one or more polysaccharides comprises one or more algae-derived phycocolloids.

12. The system of claim 10, wherein the one or more polysaccharides comprises one or more plant-derived gums.

13. The system of claim 10, wherein the reservoir is located on the offshore hydraulic dredging vessel, and wherein the sand is dredged from a seabed floor and pumped through the conduit by the offshore hydraulic dredging vessel.

14. The system of claim 10, wherein the reservoir is located on the beach.

15. The system of claim 10, wherein the reservoir is located on a support vessel.

16. The system of claim 10, wherein the beach comprises an escarpment, and wherein the pumped slurry, sand, and seawater collapses the escarpment.

17. The system of claim 16, wherein the beach includes one or more sea turtle nesting sites.

18. The system of claim 10, wherein the reservoir comprises a mixer and a drum.

* * * * *